US011543782B2

(12) United States Patent
Katsuda et al.

(10) Patent No.: US 11,543,782 B2
(45) Date of Patent: Jan. 3, 2023

(54) TIMEPIECE

(71) Applicant: CASIO COMPUTER CO., LTD., Tokyo (JP)

(72) Inventors: Hiroshi Katsuda, Kodaira (JP); Hiroaki Otsubo, Higashimurayama (JP); Tomoyasu Kurokawa, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 261 days.

(21) Appl. No.: 16/745,439

(22) Filed: Jan. 17, 2020

(65) Prior Publication Data

US 2020/0233382 A1 Jul. 23, 2020

(30) Foreign Application Priority Data

Jan. 17, 2019 (JP) ..... JP2019-005911

(51) Int. Cl.
*G04G 21/04* (2013.01)
*G04R 60/10* (2013.01)
*G04R 60/04* (2013.01)

(52) U.S. Cl.
CPC ..... *G04G 21/04* (2013.01); *G04R 60/04* (2013.01); *G04R 60/10* (2013.01)

(58) Field of Classification Search
CPC ..... G04R 60/04; G04R 20/02; G04R 60/10; G04G 21/04; G04G 5/002; G04B 47/00
See application file for complete search history.

(56) References Cited

U.S. PATENT DOCUMENTS 9,196,952 B2 11/2015 Tran et al.
10,739,465 B2 8/2020 Katsuda et al.
(Continued)

FOREIGN PATENT DOCUMENTS

CN 105789822 A * 7/2016
CN 106207381 A 12/2016
(Continued)

OTHER PUBLICATIONS

First Office Action dated Mar. 15, 2021 received in Chinese Patent Application No. CN 202010043073.4 together with an English language translation.
(Continued)

*Primary Examiner* — Edwin A. Leon
(74) *Attorney, Agent, or Firm* — Scully Scott Murphy & Presser

(57) ABSTRACT

A timepiece is provided which ensures connection reliability and improves antenna characteristics. This timepiece includes a wristwatch case which houses a timepiece module, and an antenna which is provided on the upper surface of the wristwatch case in a discontinuous annular shape along the circumferential direction of the wristwatch case and electrically connected to the timepiece module in the wristwatch case from outside the wristwatch case. As a result, since the antenna is electrically connected to the timepiece module in the wristwatch case from outside the wristwatch case, the antenna and the timepiece module are unfailingly and favorably connected to each other. Accordingly, the connection reliability of the antenna is ensured and radio waves are favorably received. In addition, the reception performance and the antenna gain are improved, whereby the antenna characteristics are improved.

9 Claims, 8 Drawing Sheets

(56) References Cited

U.S. PATENT DOCUMENTS

| | | | | |
|---|---|---|---|---|
| 2014/0266920 | A1 | 9/2014 | Tran et al. | |
| 2018/0224556 | A1 | 8/2018 | Katsuda et al. | |
| 2019/0229397 | A1 * | 7/2019 | Rizzo | H01Q 1/48 |

FOREIGN PATENT DOCUMENTS

| | | | | |
|---|---|---|---|---|
| CN | 206649291 | U | 11/2017 | |
| EP | 2317602 | A1 * | 5/2011 | G04G 5/002 |
| JP | H11-064544 | A | 3/1999 | |
| JP | 2004-109115 | A | 4/2005 | |
| JP | 2011139195 | A | 7/2011 | |
| JP | 2015-008513 | A | 1/2015 | |
| JP | 2016517670 | A | 6/2016 | |
| JP | 2016161393 | A | 9/2016 | |
| JP | 2018129573 | A | 8/2018 | |
| JP | 2018-169189 | A | 11/2018 | |
| JP | 2019032212 | A * | 2/2019 | |
| JP | 2019056616 | A * | 4/2019 | |
| JP | 6901945 | B2 * | 7/2021 | |

OTHER PUBLICATIONS

Notice of Reasons for Refusal dated Sep. 13, 2022 received in Japanese Patent Application No. JP 2019-005911.

Notice of Reasons for Refusal dated Nov. 16, 2022 received in Japanese Patent Application No. JP 2019-005911.

* cited by examiner

TIMEPIECE

CROSS-REFERENCE TO RELATED APPLICATION

This application is based upon and claims the benefit of priority from the prior Japanese Patent Application No. 2019-005911, filed Jan. 17, 2019, the entire contents of which are incorporated herein by reference.

BACKGROUND

1. Technical Field

The technical field relates to a timepiece.

2. Description of the Related Art

For example, a wristwatch is known which has a structure where an antenna has been provided on an outer circumference portion of a discoid dial plate in a wristwatch case along the circumference of the outer circumference portion, as shown in Japanese Patent Application Laid-Open (Kokai) Publication No. 2015-008513.

SUMMARY

In one embodiment, a timepiece is disclosed.

An embodiment of the present invention is a timepiece comprising: a case which houses a module; and an antenna which is provided in a discontinuous annular shape on one surface of the case and electrically connected to the module in the case from outside the case.

The above and further objects and novel features of one embodiment will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

A wristwatch of an embodiment will hereinafter be described with reference to FIG. 1 to FIG. 8.

Figure 1:
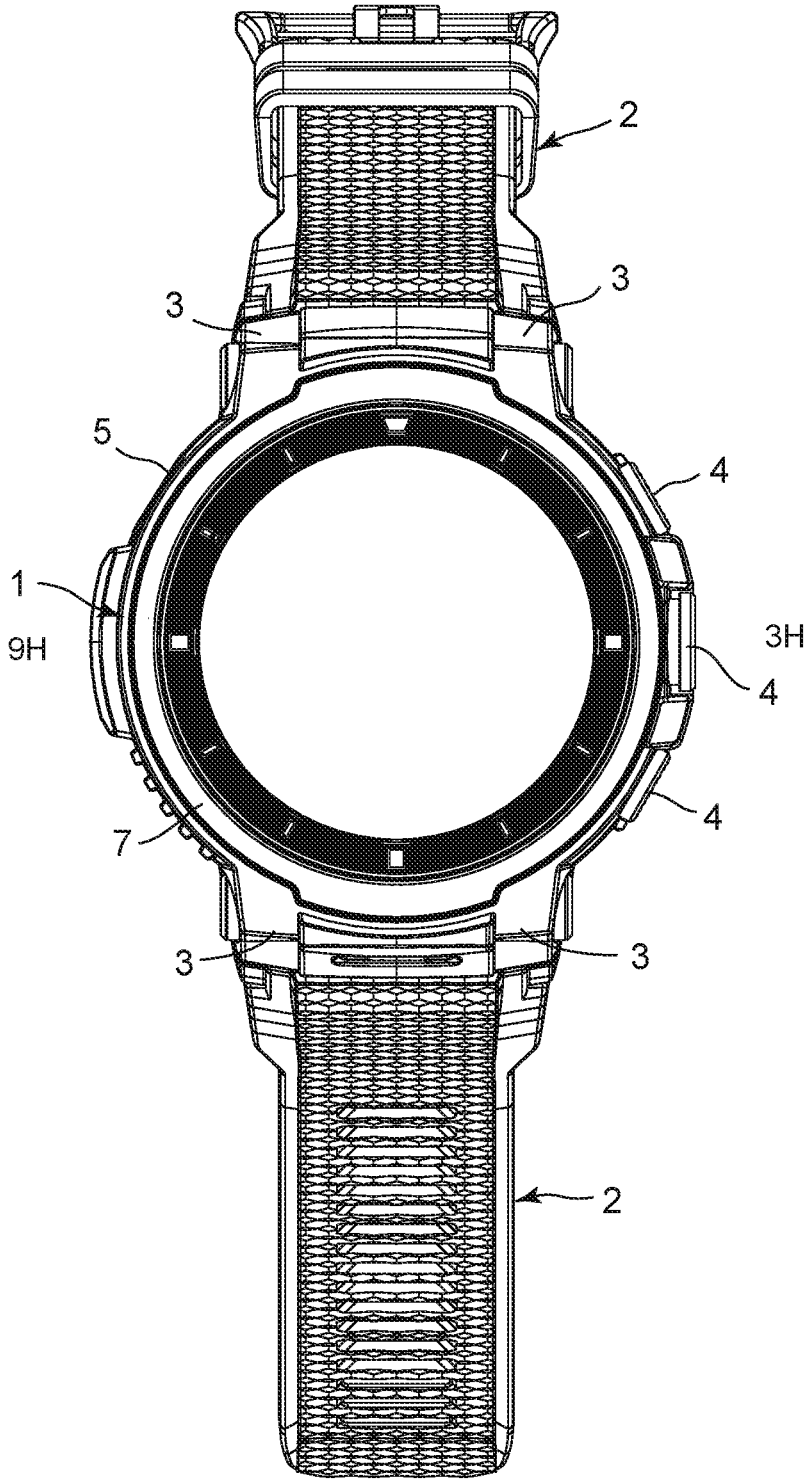
FIG. 1 is an enlarged front view showing a wristwatch of an embodiment.

This wristwatch includes a wristwatch case 1, as shown in FIG. 1. On the 12 o'clock side and the 6 o'clock side of the wristwatch case 1, band attachment sections 3 to which watch bands 2 are attached are provided, respectively. Also, on the 2 o'clock side, the 3 o'clock side, and the 4 o'clock side of the wristwatch case 1, switches 4 are provided. Moreover, on the 10 o'clock side of the wristwatch case 1, a charge terminal section 5 is provided.

This wristwatch case 1 is formed of a hard synthetic resin. On the upper part of the wristwatch case 1, a cover member 7 which covers and protects an antenna 6 described later is provided, as shown in FIG. 1. Also, to the opening of the wristwatch case 1, a glass plate 8 is attached via a packing 8*a*, as shown in FIG. 4. Moreover, to the lower part of the wristwatch case 1, a back cover 10 made of metal such as stainless steel is attached with screws (not shown) via a waterproof ring 10*a*, as shown in FIG. 3 and FIG. 4.

Figure 3:
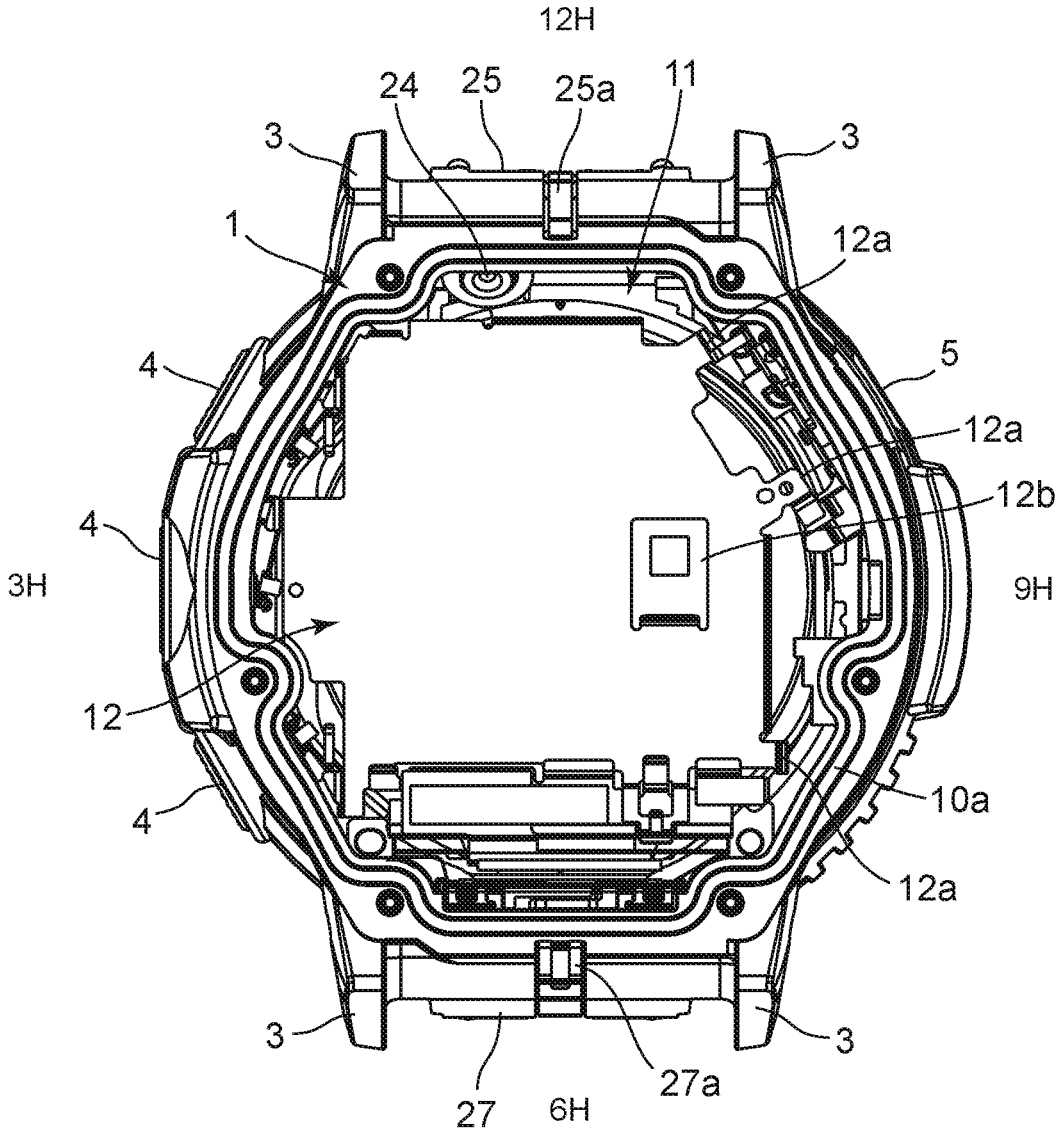
FIG. 3 is an enlarged rear view showing a state where a back cover has been removed from the undersurface of the wristwatch case shown in FIG. 1.
Figure 4:
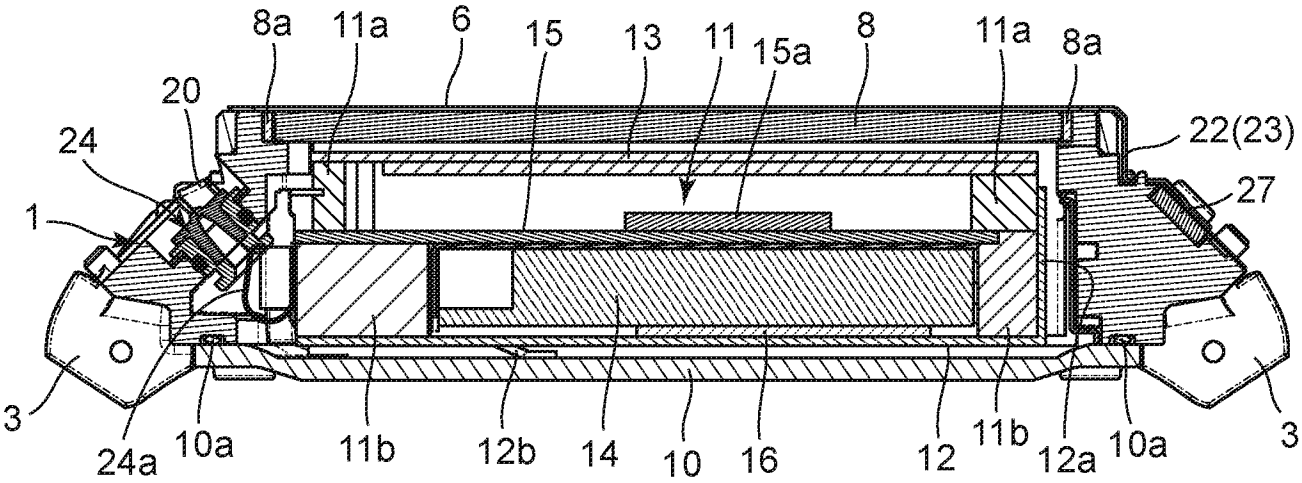
FIG. 4 is an enlarged cross-sectional view of the wristwatch case taken along line A-A shown in FIG. 2.

Inside this wristwatch case 1, a timepiece module 11 is arranged, as shown in FIG. 3 and FIG. 4. This timepiece module 11 includes an upper housing 11*a* and a lower housing 11*b*, which are attached to each other by a metal hold-down plate 12 with them being overlapped with each other.

That is, in this timepiece module 11, the upper housing 11*a* and the lower housing 11*b* are attached to each other by a plurality of hooks 12*a* of the hold-down plate 12 catching the side surface of the upper housing 11*a* after catching the side surface of the lower housing 11*b* with the upper housing 11*a* and the lower housing 11*b* being overlapped with each other, as shown in FIG. 3 and FIG. 4.

In this embodiment, in the upper housing 11*a*, a display section 13 is provided which is a flat type display panel that displays various types of information such as time required for a timepiece function, as shown in FIG. 4. In the lower housing 11*b*, a rechargeable battery 14 is housed. Also, in an area between the upper housing 11*a* and the lower housing 11*b*, a circuit board 15 is provided.

In this circuit board 15, various types of electronic components 15*a* required for the timepiece function are mounted, and the display section 13 and the rechargeable battery 14 are electrically connected thereto, as shown in FIG. 4. As a result, in the circuit board 15, electric power is supplied from the rechargeable battery 14, and the various types of electronic components 15*a* drive the display section 13 so as to display various types of information on the display section 13.

Figure 5:
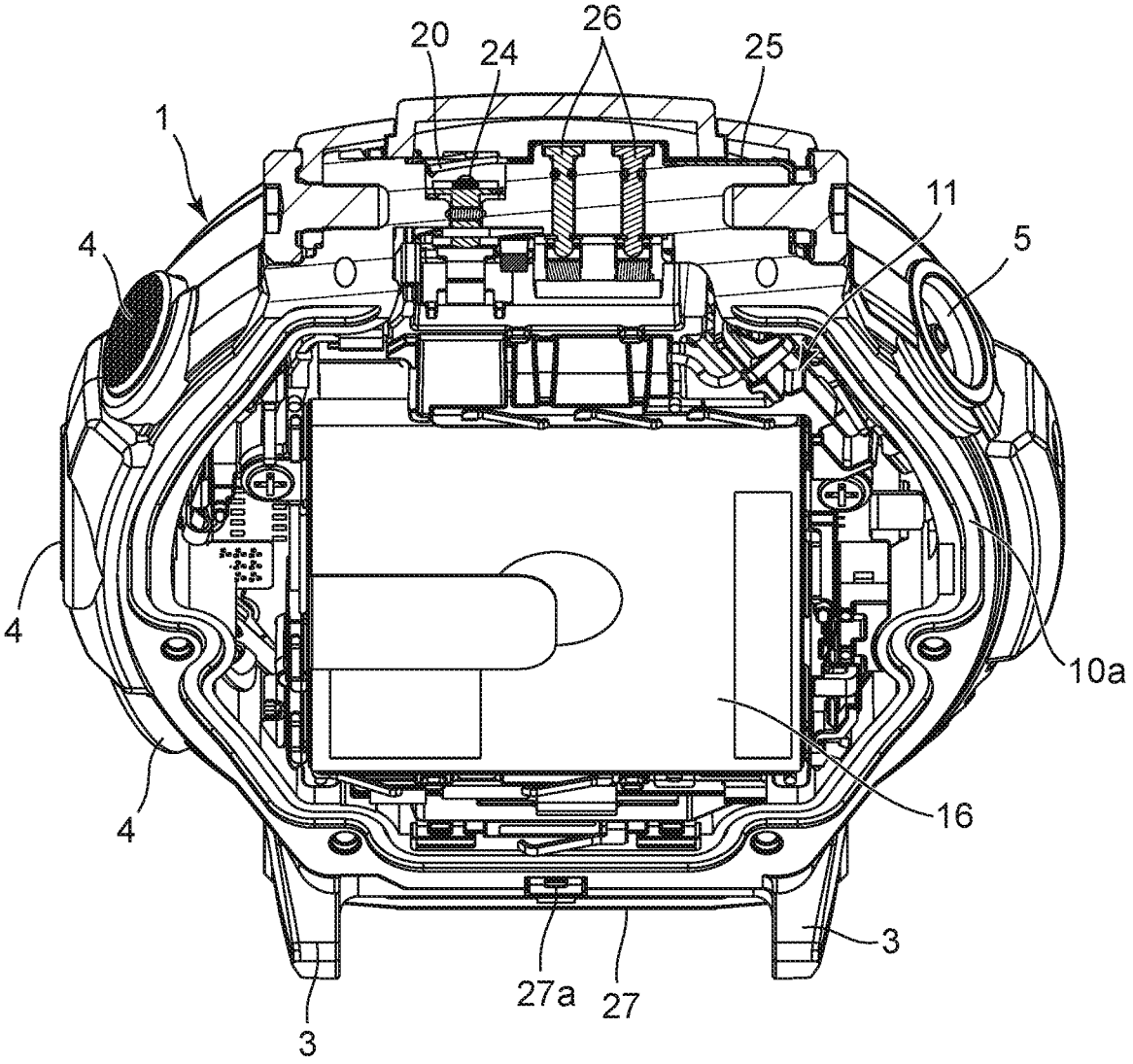
FIG. 5 is an enlarged perspective view showing the main part of the wristwatch case taken along line B-B shown in FIG. 2 and viewed from diagonally below.

In an area between the lower housing 11*b* and the hold-down plate 12, a first metal plate 16 is arranged with it being in contact with and electrically connected to the hold-down plate 12, as shown in FIG. 4 and FIG. 5. This first metal plate 16 is connected to a ground electrode (not shown) of the circuit board 15 via the hold-down plate 12.

The hold-down plate 12 is electrically connected to the back cover 10 by a hold-down piece coming in contact with the back cover 10, as shown in FIG. 3 and FIG. 4. Also, this hold-down plate 12 is connected to the ground electrode of the circuit board 15. As a result, the back cover 10 is electrically connected to the ground electrode of the circuit board 15 by the hold-down plate 12 and the first metal plate 16, and thereby has a potential equal to the ground potential. On the surface of the hold-down plate 12, a conductive film made of gold (Au) or the like having high conductivity is provided by surface treatment such as vapor deposition, plating, or preferably ion plating.

Figure 2:
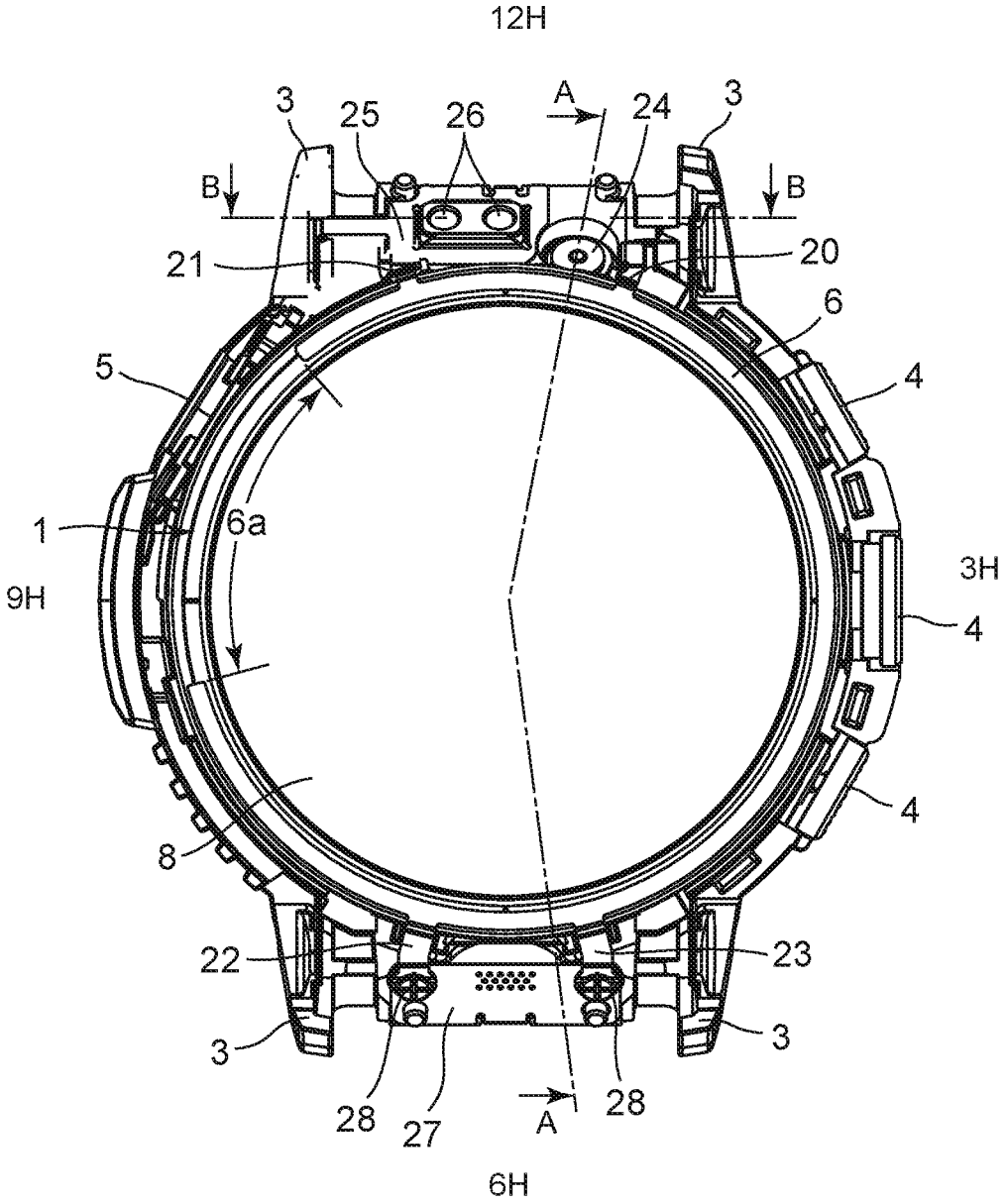
FIG. 2 is an enlarged front view showing a state where a cover member has been removed from the upper surface of a wristwatch case shown in FIG. 1.

The antenna 6 provided on the upper part of the wristwatch case 1, which is used for GPS (Global Positioning System), is covered by the cover member 7, as shown in FIG. 2. This antenna 6 is formed on the upper surface of the wristwatch case 1 in a discontinuous annular shape, that is, a C shape along the circumferential direction of the wristwatch case 1.

More specifically, in the antenna 6, an antenna non-forming area 6*a* is provided in a portion corresponding to the 10 o'clock side of wristwatch case 1, that is, a portion corresponding to an area between the 9 o'clock side and the 11 o'clock side. Also, this antenna 6 is formed such that its length (width) in the diameter direction is slightly shorter than the length (width) of the upper end surface of the wristwatch case 1 in the diameter direction. For example, the length (width) of the antenna 6 in the diameter direction, which is formed to be 1/10 to 1/20 of the radius of the antenna 6, should preferably be about 1/15 of the antenna 6.

This antenna 6 is electrically connected to the timepiece module 11 inside the wristwatch case 1 from outside the wristwatch case 1 through the band attachment sections 3 on the 12 o'clock side and the 6 o'clock side of the wristwatch case 1, as shown in FIG. 2. More specifically, this antenna 6 includes a feed contact section 20 and first to third ground contact sections 21 to 23, and these sections are electrically connected to the timepiece module 11.

The feed contact section 20 is electrically connected to the timepiece module 11 via a metal inner pressure regulating valve 24 that is a first connection member provided on the wristwatch case 1, as shown in FIG. 4 and FIG. 5. The inner pressure regulating valve 24, which is a first connection member, is a check valve for adjusting pressure inside the wristwatch case 1 to be the same as outside pressure when the pressure inside is high, and provided in a portion of the wristwatch case 1 which is close to the one o'clock side and corresponding to the band attachment section 3 on the 12 o'clock side.

This inner pressure regulating valve 24 is provided in the wristwatch case 1 and located at the arrangement position of the band attachment section 3 on the 12 o'clock side while being exposed to the inside and outside of the wristwatch case 1, as shown in FIG. 4 and FIG. 5. The feed contact section 20 is interposed between an outer end portion of this inner pressure regulating valve 24 and the wristwatch case 1. Also, this inner pressure regulating valve 24 is connected to the feed contact section 20 with the flange of its outer end portion pressing a portion of the feed contact section 20 against the outer surface of the wristwatch case 1. An inner end portion of this inner pressure regulating valve 24 is electrically connected to a feed electrode (not shown) of the circuit board 15 by a lead wire 24*a*.

As a result, the feed contact section 20 is pressed against and electrically connected to the metal inner pressure regulating valve 24 and, by this inner pressure regulating valve 24 being connected to the feed electrode of the circuit board 15 by the lead wire 24*a*, electrically connected to the feed electrode of the circuit board 15 in the timepiece module 11 inside the wristwatch case 1, at the arrangement position of the band attachment section 3 on the 12 o'clock side, as shown in FIG. 2, FIG. 4 and FIG. 5.

The first ground contact section 21 is electrically connected to the timepiece module 11 via the back cover 10 on the lower part of the wristwatch case 1 by a second metal plate 25 that is a second connection member provided on the wristwatch case 1, as shown in FIG. 2, FIG. 3, FIG. 5 and FIG. 6. The second metal plate 25 serving as a second connection member is a metal plate that surrounds a USB (Universal Serial Bus) terminal 26 provided on a portion of the wristwatch case 1 which is close to the 11 o'clock side and corresponding to the band attachment section 3 on the 12 o'clock side, and protects the USB terminal 26 from static electricity risk.

More specifically, the second metal plate 25 is formed into a quadrangle frame shape that surrounds the USB terminal 26, and its portion extended to the undersurface of the wristwatch case 1 serves as a first connection section 25*a* (refer to FIG. 3), as shown in FIG. 2, FIG. 3 and FIG. 5. As a result, when the back cover 10 is attached to the undersurface of the wristwatch case 1, the second metal plate 25 is electrically connected to the back cover 10 by a circumference portion of the back cover 10 coming in contact with the first connection section 25*a*, and electrically connected to the ground electrode of the circuit board 15 in the timepiece module 11 via this back cover 10.

Figure 6A:
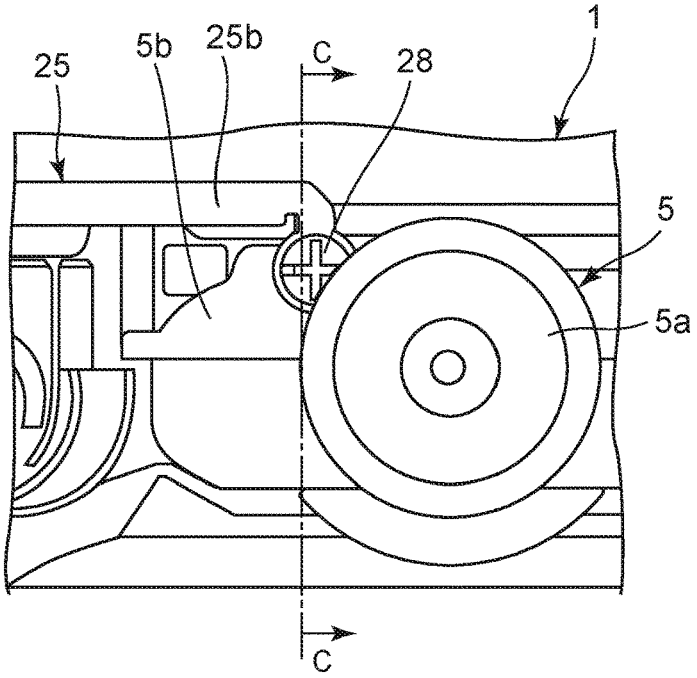
FIG. 6A is an enlarged side view showing a main portion on the 10 o'clock side of the wristwatch case shown in FIG. 2.
Figure 6B:
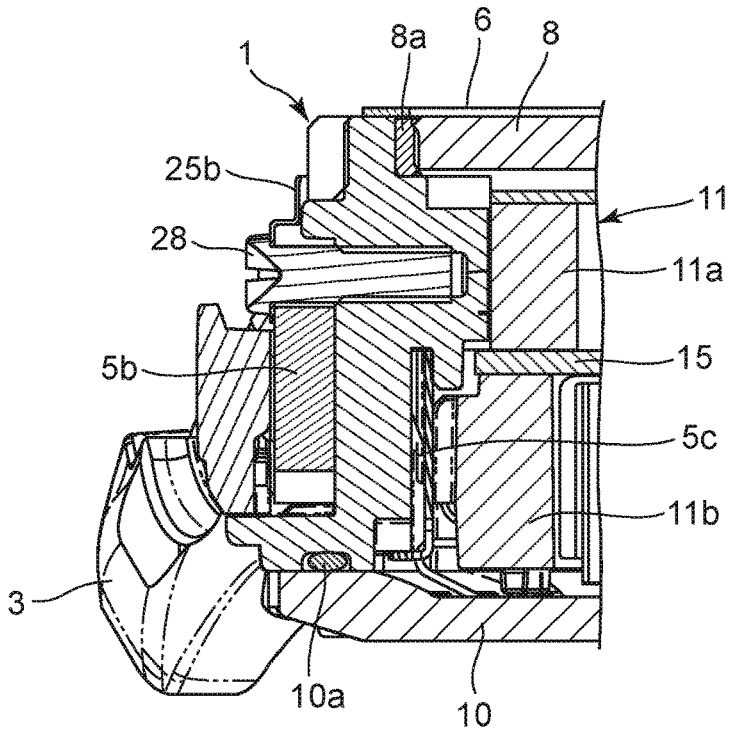
FIG. 6B is an enlarged sectional view of FIG. 6A taken along line C-C.

On the surface of the second metal plate 25, a conductive film made of gold (Au) or the like having high conductivity is provided by surface treatment such as vapor deposition, plating, or preferably ion plating, as in the case of the hold-down plate 12. Also, on this second metal plate 25, an extension section 25*b* extended to the charging terminal section 5 on the 10 o'clock side of the wristwatch case 1 is provided, as shown in FIG. 2, FIG. 5 and FIG. 6. This extension portion 25*b* is attached to the wristwatch case 1 by a first screw 28 with its tip end portion being pressed against and electrically connected to a ground section 5*b* of the charging terminal 5*a*.

Figure 8:
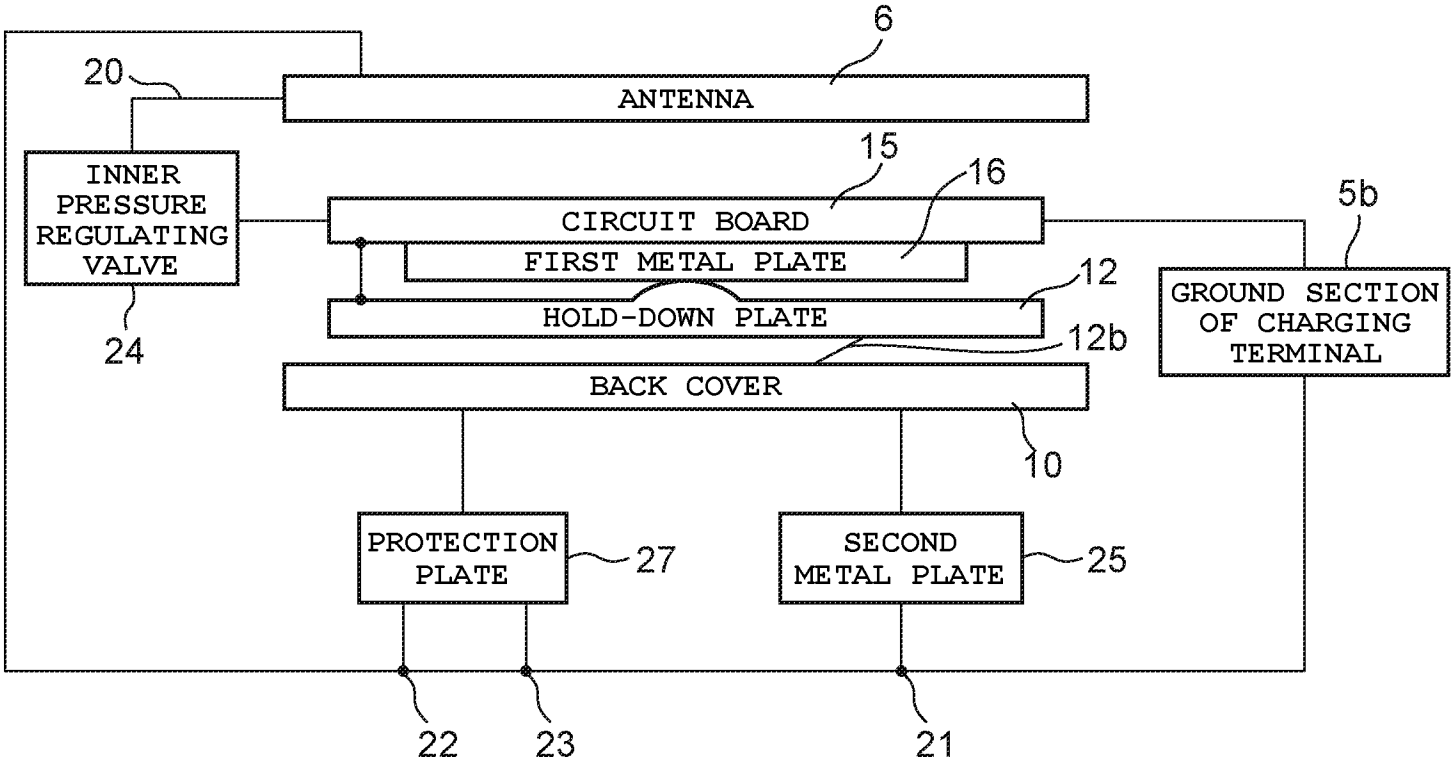
FIG. 8 is a structural view showing a connection state of an antenna shown in FIG. 4.

As a result, by the back cover 10 being brought into contact with and electrically connected to the first connection section 25*a*, the second metal plate 25 electrically connects the ground section 5*b* of the charging terminal 5*a* and the ground electrode of the circuit board 15 in the timepiece module 11 via the back cover 10, as shown in FIG. 8. In this embodiment, the ground section 5*b* of the charging terminal 5*a* is electrically connected to the ground electrode of the circuit board 15 by a terminal contact piece 5*c*. Also, the charge terminal 5*a* is connected to a charge electrode (not shown) of the circuit board 15.

Figure 7:
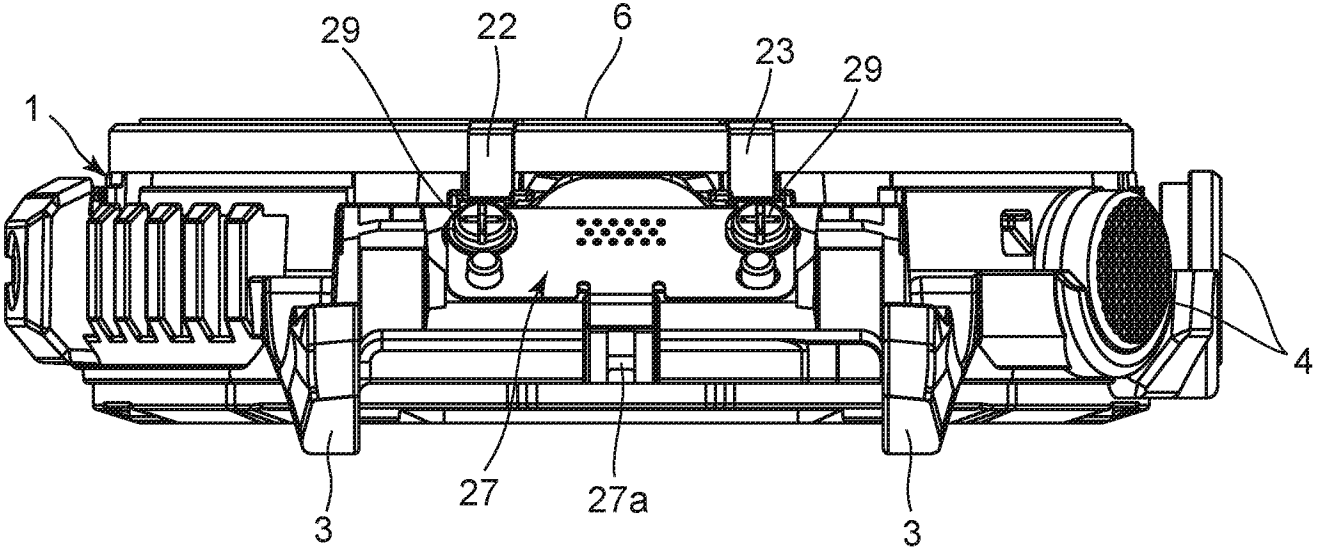
FIG. 7 is an enlarged side view showing the 6 o'clock side of the wristwatch case in FIG. 2.

The second ground contact section 22 and the third ground contact section 23 are electrically connected to the circuit board 15 of the timepiece module 11 via the back cover 10 attached to the lower part of the wristwatch case 1 by a protection plate 27 that is a third connection member for protecting a microphone (not shown) provided in the wristwatch case 1, as shown in FIG. 2, FIG. 7 and FIG. 8.

More specifically, the second ground contact section 22 is arranged on a substantially 7 o'clock side of the protection plate 27 provided on the outer surface of the wristwatch case 1 and located on the band attachment section 3 on the 6 o'clock side so as to cover the microphone (not shown), and attached to the outer surface of the wristwatch case 1 together with the protection plate 27 by a second screw 29, as shown in FIG. 2 and FIG. 7.

The third ground contact section 23 is arranged on a substantially 5 o'clock side of the protection plate 27 provided on the outer surface of the wristwatch case 1 and located on the band attachment section 3 on the 6 o'clock side, and attached to the outer surface of the wristwatch case 1 together with the protection plate 27 by a second screw 29 as in the case of the second ground contact section 22, as shown in FIG. 2 and FIG. 7.

The protection plate 27 is a metal plate that covers and protects the microphone (not shown) provided on a portion of the wristwatch case 1 corresponding to the band attachment section 3 on the 6 o'clock side in a manner to be exposed to the inside and outside of the wristwatch case 1, and a number of small holes are provided in the protection plate 27 in a manner to correspond to the microphone, as shown in FIG. 2 and FIG. 7. On the surface of this protection plate 27 as well, a conductive film made of gold (Au) or the like having high conductivity is provided by surface treatment such as vapor deposition, plating, or preferably ion plating, as in the case of the hold-down plate 12.

On this protection plate 27, a second connection section 27*a* whose lower edge portion is extended to the undersurface of the wristwatch case 1 is provided, as shown in FIG. 3 and FIG. 7. As a result, when the back cover 10 is attached to the undersurface of the wristwatch case 1, the protection plate 27 is electrically connected to the back cover 10 by a circumference portion of the back cover 10 coming in contact with the second connection section 27*a*, and electrically connected to the ground electrode of the circuit board 15 in the timepiece module 11 via this back cover 10.

Accordingly, in a state where the back cover 10 has been connected to the ground electrode of the circuit board 15 in the timepiece module 11 by the hold-down plate 12 and the first metal plate 16, the antenna 6 is connected to the ground electrode of the circuit board 15 via the back cover 10 by the feed contact section 20 being connected to the feed electrode of the circuit board 15 via the metal inner pressure regulating valve 24 and the first ground contact section 21 being connected to the back cover 10 by the second metal plate 25, as shown in FIG. 8.

Also, this antenna 6 is connected to the ground electrode of the circuit board 15 via the back cover 10 by the second ground contact section 22 and the third ground contact section 23 being connected to the back cover 10 by the protection plate 27 for the microphone, as shown in FIG. 8. As a result, the antenna 6 receives radio waves for GPS.

The charging terminal section 5 is connected to the ground electrode of the circuit board 15 via the back cover 10 by the ground section 5*b* of the charging terminal 5*a* being connected to the ground electrode of the circuit board 15 by the terminal contact piece 5*c* and connected to the back cover 10 by the second metal plate 25, as shown in FIG. 8.

The feed contact section 20 of the antenna 6 is arranged on a portion of the wristwatch case 1 which is close to the 1 o'clock side and corresponding to the band attachment section 3 on the 12 o'clock side, as shown in FIG. 2. Also, the first ground contact section 21 is arranged on a portion of the wristwatch case 1 which is close to the 11 o'clock side and corresponding to the band attachment section 3 on the 12 o'clock side. That is, the first ground contact section 21 is arranged to be separated from the feed contact section 20 by a length equivalent to a predetermined opening angle in the counter clockwise direction, such as an opening angle of about 30 degrees.

Moreover, the second ground contact section 22 is arranged on a portion of the wristwatch case 1 which is close to the 7 o'clock side and corresponding to the band attachment section 3 on the 6 o'clock side. That is, the second ground contact section 22 is substantially diagonally arranged opposing the feed contact section 20 such that a length therebetween is equivalent to a predetermined opening angle in the clockwise direction, such as an opening angle of about 180 degrees.

Furthermore, the third ground contact section 23 is arranged on a portion of the wristwatch case 1 which is close to the 5 o'clock side and corresponding to the band attachment section 3 on the 6 o'clock side. That is, the third ground contact section 23 is arranged to be separated from the feed contact section 20 by a length equivalent to a predetermined opening angle in the clockwise direction, such as an opening angle of about 150 degrees.

As a result, by the arrangement relation of the first to third ground contact sections 21 to 23 with respect to the feed contact section 20, the reception performance of the antenna 6 for receiving radio waves for GPS is improved, and the antenna gain is improved, as shown in FIG. 2 and FIG. 8. Accordingly, the antenna 6 reliably and favorably receives radio waves for GPS.

Next, the mechanism of the antenna 6 of this wristwatch is described.

When the antenna 6 is to be attached to the wristwatch case 1, first, the antenna 6 is arranged on the upper surface of the wristwatch case 1. Here, the antenna non-forming area 6*a* is arranged corresponding to an area on the 10 o'clock side of the wristwatch case 1, that is, an area between the 9 o'clock side and the 11 o'clock side.

Also, here, the feed contact section 20 is arranged on the portion of the wristwatch case 1 which is close to the 1 o'clock side and corresponding to the band attachment section 3 on the 12 o'clock side, and the first ground contact section 21 is arranged on the portion of the wristwatch case 1 which is close to the 11 o'clock side and corresponding to the band attachment section 3 on the 12 o'clock side. Moreover, the second ground contact section 22 is arranged on the portion of the wristwatch case 1 which is close to the 7 o'clock side and corresponding to the band attachment section 3 on the 6 o'clock side, and the third ground contact section 23 is arranged on the portion of the wristwatch case 1 which is close to the 5 o'clock side and corresponding to the band attachment section 3 on the 6 o'clock side.

In this state, the switches 4 are attached to the 2 o'clock side, the 3 o'clock side, and the 4 o'clock side of the wristwatch case 1, respectively, and the charge terminal section 5 is arranged on the 10 o'clock side. Also, here, the inner pressure regulating valve 24 and the USB terminal 26 are attached to the portions of the wristwatch case 1 corresponding to the band attachment section 3 on the 12 o'clock side, and the microphone (not shown) is attached to the portion of the wristwatch case 1 corresponding to the band attachment section 3 on the 6 o'clock side.

Then, the feed contact section 20 of the antenna 6 is connected to the inner pressure regulating valve 24. Here, the feed contact section 20 is pressed against the outer surface of the wristwatch case 1 by the flange portion of the inner pressure regulating valve 24. In addition, the first ground contact section 21 of the antenna 6 is connected to the second metal plate 25 arranged around the USB terminal 26.

Also, the second metal plate 25 is arranged around the USB terminal 26 on the outer surface of the wristwatch case 1. Here, the first connection section 25*a* of the second metal plate 25 is arranged with it being extended to the undersurface of the wristwatch case 1. In addition, the tip end portion of the extension section 25*b* of the second metal plate 25 is arranged on the ground section 5*b* of the charging terminal 5*a* arranged on the 10 o'clock side of the wristwatch case 1.

In this state, the first ground contact section 21 is connected to the second metal plate 25. Here, the first ground contact section 21 is pressed against the outer surface of the wristwatch case 1 by the second metal plate 25. Also, in this state, the extension section 25*b* of the second metal plate 25 is connected to the ground section 5*b* of the charging terminal 5*a*. Here, the tip end portion of the extension section 25*b* of the second metal plate 25 is attached to the wristwatch case 1 by the first screw 28 with it being in contact with and arranged on the ground section 5*b* of the charging terminal 5*a*.

Also, the second ground contact section 22 and the third ground contact section 23 of the antenna 6 are connected to the protection plate 27 for the microphone (not shown). Here, before this connection, the protection plate 27 is arranged on the outer surface portion of the wristwatch case 1 corresponding to the microphone, and the second connection section 27*a* of the protection plate 27 is arranged on the undersurface of the wristwatch case 1. In this state, the second ground contact section 22 and the third ground contact section 23 are attached to the wristwatch case 1 together with the protection plate 27 by the second screws 29

Then, the timepiece module 11 is mounted on the wristwatch case 1. Here, the timepiece module 11 is assembled in advance. More specifically, the display section 13 is mounted on the upper housing 11*a*, and the rechargeable battery 14 is mounted on the lower housing 11*b*. In this state, the circuit board 15 is arranged between the upper housing 11*a* and the lower housing 11*b*, and the upper housing 11*a* and the lower housing 11*b* are overlapped with and attached to each other by the hold-down plate 12. As a result, the timepiece module 11 is assembled.

Here, the lead wire 24*a* connected to the inner end portion of the inner pressure regulating valve 24 is connected to the feed electrode (not shown) of the circuit board 15. Also, when the upper housing 11*a* and the lower housing 11*b* are to be attached to each other by the hold-down plate 12, the first metal plate 16 is arranged between the lower housing 11*b* and the hold-down plate 12 and brought into contact with the hold-down plate 12, and the hold-down plate 12 is connected to the ground electrode of the circuit board 15 together with the first metal plate 16.

Also, when the timepiece module 11 is arranged in the wristwatch case 1, the charging terminal 5*a* of the charging terminal section 5 is electrically connected to the circuit board 15, and the ground section 5*b* of the charging terminal 5*a* is connected to the ground electrode of the circuit board 15 by the terminal contact piece 5*c*. As a result, the timepiece module 11 is mounted in the wristwatch case 1.

Then, the back cover 10 is arranged on the undersurface of the wristwatch case 1 via the waterproof ring 10*a*, and attached thereto in this state by screws (not shown). As a result, the hold-down piece 12*b* of the hold-down plate 12 is brought into contact with and connected to the inner surface of the back cover 10. Here, the circumference portion of the back cover 10 is pressed against and electrically connected to the first connection section 25*a* of the second metal plate 25 to which the first ground contact section 21 has been connected. In addition, the circumference portion of the back cover 10 is pressed against and electrically connected to the second connection section 27*a* of the protection plate 27 to which the second ground contact section 22 has been connected.

As a result, in the state where the back cover 10 has been connected to the ground electrode of the circuit board 15 in the timepiece module 11 via the hold-down plate 12 and the first metal plate 16, the feed contact section 20 of the antenna 6 is connected to the feed electrode of the circuit board 15 via the metal inner pressure regulating valve 24, and the first ground contact section 21 of the antenna 6 is connected to the ground electrode of the circuit board 15 via the second metal plate 25, as shown in FIG. 8.

Then, the cover member 7 is attached to the upper edge of the wristwatch case 1 so as to cover the antenna 6. As a result, the antenna 6, the upper part of the feed contact section 20, and the upper parts of the first to third ground contact sections 21 to 23 are protected. Accordingly, even when the wristwatch case 1 receives an external impact, the antenna 6 is reliably protected by the cover member 7 so as not to be damaged.

Also, the watch band 2 is attached to the band attachment sections 3 of the wristwatch case 1 on the 12 o'clock side and the 6 o'clock side, respectively. As a result, the feed contact section 20 of the antenna 6, the first ground contact section 21, the inner pressure regulating valve 24, the USB terminal 26, and the second metal plate 25 arranged exposing on the band attachment section 3 on the 12 o'clock side are covered and protected by the watch band 2. In addition, the second ground contact section 22 of the antenna 6, the third ground contact section 23, and the protection plate 27 arranged exposing on the band attachment section 3 on the 6 o'clock side are covered and protected by the watch band 2.

Accordingly, by the watch bands 2 attached to the band attachment sections 3 on the 12 o'clock side and the 6 o'clock side, the feed contact section 20 of the antenna 6, the inner pressure regulating valve 24, the USB terminal 26, the second metal plate 25, and the first to third ground contact sections 21 to 23 of the antenna 6, and the protection plate 27 are reliably protected so as not to be damaged when an external impact is exerted onto the wristwatch case 1, whereby poor electrical connection can be prevented.

In the structure of this antenna 6, in the state where the back cover 10 has been connected to the ground electrode of the circuit board 15 in the timepiece module 11, the feed contact section 20 is connected to the feed electrode of the circuit board 15 via the metal inner pressure regulating valve 24, the first ground contact section 21 is connected to the ground electrode of the circuit board 15 via the second metal plate 25, and the second and third ground contact sections 22 and 23 are connected to the ground electrode of the circuit board 15 via the protection plate 27. Accordingly, the reception performance for receiving radio waves for GPS is improved, and the antenna gain is improved. As a result, radio waves for GPS can be unfailingly and favorably received.

Also, in the structure of this antenna 6, the first ground contact section 21 is arranged to be separated from the feed contact section 20 by a length equivalent to a predetermined opening angle such as an opening angle of about 30 degrees in the counter clockwise direction, the second ground contact section 22 is substantially diagonally arranged opposing the feed contact section 20 such that a length therebetween is equivalent to a predetermined opening angle such as an opening angle of about 180 degrees in the clockwise direction, and the third ground contact section 23 is arranged to be separated from the feed contact section 20 by a length equivalent to a predetermined opening angle such as an opening angle of about 150 degrees in the clockwise direction.

That is, in the structure of this antenna 6, the arrangement relation of the first to third ground contact sections 21 to 23 with respect to the feed contact section 20 also reliably improves the reception performance for receiving radio waves for GPS and further improves the antenna gain. As a result, radio waves for GPS can be more unfailingly and more favorably received.

Also, this antenna 6 is formed on the upper surface of the wristwatch case 1 in the discontinuous annular shape, that is, the C shape along the circumferential direction of the wristwatch case 1 by the antenna non-forming area 6*a* being provided in the portion corresponding to the 10 o'clock side of wristwatch case 1, that is, the portion corresponding to the area between the 9 o'clock side and the 11 o'clock side, and the length (width) of the antenna 6 in the diameter direction is slightly shorter than the length (width) of the upper end surface of the wristwatch case 1 in the diameter direction and is about 1/15 of the radius of the antenna 6. By this structure as well, the reception performance for receiving radio waves for GPS and the antenna gain are improved.

As described above, this wristwatch includes the wristwatch case 1 which houses the timepiece module 11, and the antenna 6 which is provided on the upper surface of the wristwatch case 1 in the discontinuous annular shape along the circumferential direction of the wristwatch case 1 and electrically connected to the timepiece module 11 in the wristwatch case 1 from outside the wristwatch case 1. As a result, the connection reliability of the antenna 6 is ensured and the antenna characteristics are improved.

Also, in this wristwatch, since the antenna 6 is electrically connected to the timepiece module 11 in the wristwatch case 1 from outside the wristwatch case 1, the antenna 6 and the timepiece module 11 are unfailingly and favorably connected to each other. Accordingly, the connection reliability of the antenna 6 is ensured and radio waves are favorably received. In addition, the reception performance and the antenna gain are improved, whereby the antenna characteristics are improved. Moreover, in this wristwatch, the connection structure of the antenna is unlikely to be complicated.

Moreover, in this wristwatch, the antenna 6 is electrically connected to the timepiece module 11 via the arrangement positions of the band attachment sections on the 12 o'clock side and the 6 o'clock side of the wristwatch case 1. As a result, the antenna 6 can be electrically connected to the timepiece module 11 via the feed contact section 20, the first to third ground contact sections 21 to 23, the inner pressure regulating valve 24, the second metal plate 25, and the protection plate 27. That is, by being arranged on the position corresponding to the band attachment sections 3 of the wristwatch case 1, the antenna 6 can be electrically connected to the timepiece module 11 via the parts connected to the antenna 6 such as the feed contact section 20, the first to third ground contact sections 21 to 23, the inner pressure regulating valve 24, the second metal plate 25, and the protection plate 27. Accordingly, even though the antenna 6 is provided outside the wristwatch case 1, this antenna 6 can be favorably connected to the timepiece module 11 inside the wristwatch case 1.

Furthermore, in this wristwatch, even though the connected parts such as the feed contact section 20, the first to third ground contact sections 21 to 23, the inner pressure regulating valve 24, the second metal plate 25, and the protection plate 27 are exposed to the outside of the wristwatch case 1, these parts can be protected by the watch bands 2 by these watch bands being attached to the band attachment sections 3. Accordingly, disconnection of or damage to the connected parts can be prevented, which ensures the connection reliability of the antenna 6.

Still further, in this wristwatch, the antenna 6 includes the feed contact section 20 and the first to third ground contact sections 21 to 23 which are electrically connected to the timepiece module 11, whereby the reception performance of the antenna 6 is ensured, and radio waves can be reliably and favorably received by the antenna 6.

Also, the feed contact section 20 is electrically connected to the timepiece module 11 by the metal inner pressure regulating valve 24 which is the first connection member provided on the portion of the wristwatch case 1 corresponding to the band attachment section 3 on the 12 o'clock side. Therefore, the feed contact section 20 can be unfailingly and favorably connected to the timepiece module 11 in the wristwatch case 1 by the inner pressure regulating valve 24 without using any special connection member as a separate member.

That is, the inner pressure regulating valve 24 is provided on the portion of the wristwatch case 1 corresponding to the band attachment section 3 on the 12 o'clock side, and the inner end portion of this inner pressure regulating valve 24 is electrically connected to the timepiece module 11 by the lead wire 24*a*. On the other hand, by being pressed against and brought into contact with the outer surface of the wristwatch case 1 by the inner pressure regulating valve 24, the feed contact section 20 can be connected to the inner pressure regulating valve 24. As a result, by the inner pressure regulating valve 24, the feed contact section 20 can be connected to the timepiece module 11 in the wristwatch case 1.

Also, in this wristwatch, the first ground contact section 21 is electrically connected to the timepiece module 11 via the back cover 10 on the undersurface of the wristwatch case 1 by the second metal plate 25 which is used for the USB terminal 26 and is the second connection member provided on the position corresponding to the band attachment section 3 on the 12 o'clock side of the wristwatch case 1. As a result, the first ground contact section 21 can be reliably and favorably connected to the timepiece module 11 by using the second metal plate 25 that protects the USB terminal 26 from static electricity risk, without using any special connection member as a separate member.

Moreover, on the second metal plate 25, the first connection section 25*a* is provided which extends from a portion of the second metal plate 25 to the undersurface of the wristwatch case 1. When the back cover 10 is attached to the undersurface of the wristwatch case 1, the circumference portion of the back cover 10 is brought into contact with and electrically connected to this first connection section 25*a*. Accordingly, via this back cover 10, the second metal plate 25 can be easily and unfailingly connected to the ground electrode of the timepiece module 11.

Also, the extension section 25*b* of this second metal plate 25 is extended to the charging terminal section 5 provided on the 10 o'clock side of the wristwatch case 1, and the tip end portion of this extension section 25*b* is electrically connected to the ground section 5*b* of the charging terminal 5*a* by the first screw 28, whereby the ground section 5*b* of the charging terminal 5*a* can be connected to the back cover 10 by the second metal plate 25. In addition, the ground section 5*b* can be connected to the ground electrode of the timepiece module 11 via this back cover 10, which simplifies the connection of the ground section 5*b* of the charging terminal 5*a*.

Also, in this wristwatch, the second ground contact section 22 and the third ground contact section 23 are electrically connected to the timepiece module 11 via the back cover 10 on the undersurface of the wristwatch case by the protection plate 27 which is used for the microphone and is the third connection member provided on the position corresponding to the band attachment section 3 on the 6 o'clock side of the wristwatch case 1. As a result, the second ground contact section 22 and the third ground contact section 23 can be reliably and favorably connected to the timepiece module 11 by using the protection plate 27 for the microphone, without using any special connection member as a separate member.

On this protection plate 27 for the microphone, the second connection section 27*a* is provided which extends from a portion of the protection plate 27 to the undersurface of the wristwatch case 1. When the back cover 10 is attached to the undersurface of the wristwatch case 1, the circumference portion of the back cover 10 is brought into contact with and electrically connected to this second connection section 27*a*. Accordingly, via this back cover 10, the protection plate 27 can be easily and unfailingly connected to the ground electrode of the timepiece module 11.

Also, in this wristwatch, the first ground contact section 21 is arranged to be separated from the feed contact section 20 by a length equivalent to a predetermined opening angle in the counter clockwise direction, the second ground contact section 22 is substantially diagonally arranged opposing the feed contact section 20 such that a length therebetween is equivalent to a predetermined opening angle, and the third ground contact section 23 is arranged to be separated from the feed contact section 20 by a length equivalent to an opening angle in the clockwise direction which is smaller than the predetermined opening angle for the second ground contact section 22. As a result, the reception performance for receiving radio waves and the antenna gain are improved, whereby radio waves for GPS can be reliably and favorably received.

In addition, also by the arrangement relation of the first to third ground contact sections 21 to 23 with respect to the feed contact section 20, the reception performance of the antenna 6 for receiving radio waves for GPS is improved, and the antenna gain is improved, whereby radio waves for GPS can be reliably and favorably received in this wristwatch.

Also, in this wristwatch, the antenna 6 is formed on the upper surface of the wristwatch case 1 in the discontinuous annular shape, that is, the C shape along the circumferential direction of the wristwatch case 1 by the antenna non-forming area 6*a* being provided in the portion corresponding to the area between the 9 o'clock side and the 11 o'clock side, whereby the reception performance for receiving radio waves for GPS and the antenna gain are improved.

Moreover, the length (width) of the antenna 6 in the diameter direction is slightly shorter than the length (width) of the upper end surface of the wristwatch case 1 in the diameter direction, and is 1/10 to 1/20 or preferably about 1/15 of the radius of the antenna 6. By this structure as well, the reception performance for receiving radio waves for GPS and the antenna gain are improved.

In the above-described embodiment, as the first connection member, the inner pressure regulating valve 24 provided in the wristwatch case 1 is used. However, the present invention is not limited thereto. For example, a structure may be adopted in which the operating shaft of a press button switch, a metal pipe into which the operating shaft is inserted, or a simple metal bar is used as the first connection member.

Also, in the above-described embodiment, as the second connection member, the second metal plate 25 for the USB terminal 26 provided on the wristwatch case 1 is used. However, the present invention is not limited thereto. For example, a structure may be adopted in which a simple and separate metal plate is used as the second connection member.

Moreover, in the above-described embodiment, as the third connection member, the protection plate 27 for the microphone provided in the wristwatch case 1 is used. However, the present invention is not limited thereto. For example, a structure may be adopted in which a simple and separate metal plate is used as the third connection member.

Furthermore, in the above-described embodiment, as display means for displaying clock time, the display section 13 of the display panel is used. However, the present invention is not limited thereto. For example, a structure may be adopted in which not the display section 13 of the display panel but a timepiece movement that shows clock time by moving hands is included as the display means.

Still further, in the above-described embodiment, the present invention has been applied in a wristwatch. However, the present invention is not necessarily required to be applied in a wristwatch. For example, the present invention may be applied in various types of timepieces such as a travel watch, an alarm clock, a table clock and a wall clock.

While the embodiments have been described, it is intended that the invention be not limited by any of the details of the description therein but includes all the embodiments which fall within the scope of the appended claims.

What is claimed is:

1. A timepiece comprising:

a case which houses a module; and an antenna which is provided in a discontinuous annular shape on one surface of the case and electrically connected to the module in the case from outside the case, wherein the antenna includes a feed contact section that is electrically connected to the module, a first ground contact section, a second ground contact section, and a third ground contact section.

2. The timepiece according to claim 1, wherein the case has a circle surface, and the antenna is provided in the discontinuous annular shape along a circumferential direction of the circle surface.

3. The timepiece according to claim 1, wherein the antenna is electrically connected to the module via band attachment sections provided on a 12 o'clock side and a 6 o'clock side of the case.

4. The timepiece according to claim 1, wherein the feed contact section is electrically connected to the module by a first connection member provided on the case and corresponding to a band attachment section provided on a 12 o'clock side of the case.

5. The timepiece according to claim 1, wherein the first ground contact section is electrically connected to the module by a second connection member provided on the case and corresponding to a band attachment section provided on a 12 o'clock side of the case, via a back cover provided on an other surface of the case opposite to the one side.

6. The timepiece according to claim 1, wherein the second ground contact section and the third ground contact section are electrically connected to the module by a third connection member provided on the case and corresponding to a band attachment section provided on a 6 o'clock side of the case, via a back cover provided on an other surface of the case opposite to the one side.

7. The timepiece according to claim 1, wherein the first ground contact section is arranged to be separated from the feed contact section by a length equivalent to a predetermined opening angle in a counter clockwise direction, the second ground contact section is substantially diagonally arranged opposing the feed contact section such that a length therebetween is equivalent to a predetermined opening angle, and the third ground contact section is arranged to be separated from the feed contact section by a length equivalent to a predetermined opening angle in a clockwise direction which is smaller than the predetermined opening angle for the second ground contact section.

8. The timepiece according to claim 1, wherein the case has band attachment sections, and the antenna is not provided in a portion not corresponding to the band attachment sections of the case.

9. The timepiece according to claim 1, wherein the antenna is not provided in a portion corresponding to a 10 o'clock side of the case.

* * * * *